United States Patent [19]

Dickson et al.

[11] Patent Number: 4,463,048

[45] Date of Patent: Jul. 31, 1984

[54] MANUFACTURING A LAMINATED PACK OF MINERAL FIBERS AND RESULTING PRODUCT

[75] Inventors: Lyle C. Dickson, Swanton; Chester A. Hall, Jr., Sylvania; Arthur B. Havens, Toledo, all of Ohio

[73] Assignee: Owens-Corning Fiberglas Corporation, Toledo, Ohio

[21] Appl. No.: 354,575

[22] Filed: Mar. 4, 1982

[51] Int. Cl.[3] ..... C03B 37/04

[52] U.S. Cl. ..... 428/218; 65/4.4; 65/5; 65/9; 65/16; 156/62.8; 264/112; 428/280; 428/446

[58] Field of Search ..... 65/4.4, 9, 11.1, 5, 65/16; 264/112; 156/62.8; 428/241, 218, 283, 280, 285, 446, 288, 294, 298, 299, 426, 428, 409

[56] References Cited

U.S. PATENT DOCUMENTS

| | | | |
|---|---|---|---|
| 2,333,218 | 11/1943 | von Pazsiczky . | |
| 2,382,290 | 8/1945 | Callander . | |
| 2,658,848 | 11/1953 | Labino . | |
| 2,785,728 | 3/1957 | Slayter et al. . | |
| 3,824,086 | 7/1974 | Perry et al. | 65/9 |
| 3,981,708 | 9/1976 | Loeffler et al. | 65/4.4 |
| 4,120,676 | 10/1978 | Hahn et al. | 65/4 R |
| 4,124,363 | 11/1978 | Kawai | 65/10.2 X |
| 4,201,247 | 5/1980 | Shannon | 428/288 X |

*Primary Examiner*—Robert L. Lindsay, Jr.

*Attorney, Agent, or Firm*—Ronald C. Hudgens; Philip R. Cloutier; Ted C. Gillespie

[57] ABSTRACT

A method and apparatus for producing a laminated pack of mineral fibers comprising two sections, each having a forming conveyor, a plurality of sources of mineral fibers positioned to successively deposit the fibers onto the forming conveyor to form a layer of fibers, vacuum means to provide suction to the fibers through the forming conveyor, the suction being sufficient to force substantially all of the fibers down onto the forming conveyor, thereby crushing the bottom portion of the layer and forming a bottom surface which is smooth relative to the top surface, and means for joining the top surfaces of the layer formed in each section by diverting each layer downwardly while maintaining the suction on the layers to produce a laminated pack having as its outer surfaces the bottom surfaces of each of the two layers.

16 Claims, 3 Drawing Figures

MANUFACTURING A LAMINATED PACK OF MINERAL FIBERS AND RESULTING PRODUCT

TECHNICAL FIELD

This invention relates to collecting and forming fibrous mineral material into a laminated pack of mineral fibers. In one of its more specific aspects, this invention relates to distributing fibrous mineral material from a plurality of sources of mineral material as layers on forming conveyors to form a laminated pack. In one of its more specific aspects, this invention relates to the formation of insulation packs of glass fibers and in particular, light density-insulation packs suitable for use as building insulation.

BACKGROUND OF THE INVENTION

A common method of collecting fibrous material, particularly fibrous mineral material emanating from spinners, involves distributing the fibers onto a collecting surface to form a pack. The fibers can be collected as a pack on a forming conveyor positioned within a forming hood beneath the sources of fibers, and the pack can be built up continuously on the moving conveyor. Such fiber collection apparatus is usually combined with an exhaust fan positioned beneath the forming conveyor to create suction through the forming conveyor and thereby force the fibers toward the conveyor to form the layer of fibers. Insufficient suction enables some of the fibers to circulate within the forming hood in eddy currents, known as "blowback." Apparatus for forming insulation packs as thick as three inches or more typically use eight or ten sources of mineral fibers, such as fiber-forming spinners, to successively deposit the mineral fibers onto the forming conveyors. The exhaust fans associated with such apparatus for producing relatively thick insulation packs must exert extremely strong suction on the mineral fibers in order to prevent blowback of the fibers emanating from the last spinners in the multi-spinner machine.

A common problem with such apparatus is that the suction pulls the initially deposited fibers onto the belt so forcefully that the bottom portion of the layer of fibers is crushed and ends up being more dense than the top portion. The greater the final thickness of the insulation pack, the greater the density variation from the bottom to the top of the pack. For example, in an R-19 insulation pack having a nominal density of 0.6 pounds per cubic foot (PCF), the top portion of the pack can have an average density of 0.4 PCF while the bottom portion of the pack can have an average density of 0.8 PCF or greater. As more and more fibers are deposited on the forming conveyor, greater and greater pressure is exerted on the fibers in the bottom portion of the layer. The force resulting from suction on the bottom fibers is increased by the drag force of the exhaust air on the upper fibers. Strong suction from the exhaust fan causes the fibers to be held flat against the fiber-forming conveyor, and any loose fibers are forced to fill voids at the very bottom of the fibrous layer.

The gradient of forces experienced by the fibers in the collection process results in a vastly different surface between the top and the bottom portions of the layer of fibers. Whereas any large holes in the bottom surface of the layer are filled so that only small spaces between fibers on the bottom surface are present, the top surface of the layer contains many large holes and voids. This nonuniformity in the surface of the layer of fibers is an undesirable characteristic. The large number of voids and large holes on the top surface of the layer of fibers is undesirable from the standpoint of feel and appearance in the final insulation product. The bottom surface of the insulation layer, however, would provide an excellent top surface for an insulation pack, since the bottom surface has no large holes or voids. There is a need in the manufacture of insulation packs for producing an insulation pack having as its top surface a smooth surface with uniformly deposited fibers, such as the surface produced at the bottom of an insulation layer.

SUMMARY OF THE INVENTION

According to this invention, there is provided apparatus for producing a laminated pack of mineral fibers comprising (a) a first forming conveyor, a plurality of sources of mineral fibers positioned to successively deposit mineral fibers onto the first forming conveyor to form a first layer of mineral fibers, first vacuum means to provide suction to the mineral fibers through the first forming conveyor, the first vacuum means being adapted to provide sufficient suction to force substantially all of the mineral fibers downwardly onto the first forming conveyor, thereby crushing the bottom portion of the first layer and forming a first bottom surface on the first layer which is smooth relative to the top surface of the first layer, and means for changing the path of the first layer to a generally downward direction while maintaining the suction on the first layer; (b) a second forming conveyor, a plurality of sources of mineral fibers positioned to successively deposit mineral fibers onto the second forming conveyor to form a second layer of mineral fibers, second vacuum means to provide suction to the mineral fibers through the second forming conveyor, the second vacuum means being adapted to provide sufficient suction to force substantially all of the mineral fibers downwardly onto the second forming conveyor, thereby crushing the bottom portion of the second layer and forming a second bottom surface on the second layer which is smooth relative to the top surface of the second layer, and means for changing the path of the second layer to a generally downward direction while maintaining the suction on the second layer; and (c) means for joining the top surfaces of the first and second layers to produce a laminated pack having as its outer surfaces the first and second bottom surfaces.

In one embodiment of the invention the means for changing the path of the first layer comprises a rotatable slot roll around which the first forming conveyor travels.

In a specific embodiment of the invention the means for joining the first and second layers comprises the first forming conveyor and the second forming conveyor.

In a preferred embodiment of the invention the means for changing the path of the second layer comprises a second rotatable slot roll around which the second forming conveyor travels.

In another preferred embodiment of the invention, there is provided means for moving the first rotatable slot roll in a direction toward or away from the second forming conveyor.

According to this invention, there is also provided a method for producing a laminated pack of mineral fibers comprising (a) successively depositing mineral fibers from a plurality of sources of mineral fibers onto a first forming conveyor to form a first layer of mineral fibers, providing suction to the mineral fibers through the first forming conveyor, the suction being sufficient on force substantially all of the mineral fibers downwardly onto the first forming conveyor, thereby crushing the bottom portion of the first layer and forming a first bottom surface on the first layer which is smooth relative to the top surface of the first layer, and changing the path of the first layer to a generally downward direction while maintaining the suction on the first layer; (b) successively depositing mineral fibers from a plurality of sources of mineral fibers onto a second forming conveyor to form a second layer of mineral fibers, providing suction to the mineral fibers through the second forming conveyor, the suction being sufficient to force substantially all of the mineral fibers downwardly onto the second forming conveyor, thereby crushing the bottom portion of the second layer and forming a second bottom surface on the second layer which is smooth relative to the top surface of the second layer, and changing the path of the second layer to a generally downward direction while maintaining the suction on the second layer; and (c) joining the top surfaces of the first and second layers to produce a laminated pack having as its outer surfaces the first and second bottom surfaces.

In a preferred embodiment of the invention, the top surfaces are joined by directing the first and second layers between the first and second forming conveyors.

In another preferred embodiment of the invention, the paths of the first and second layers are turned downwardly around first and second slot rolls, respectively.

DESCRIPTION OF INVENTION

The invention will be described in terms of a glass fiber-forming and collecting operation. It is to be understood that the invention can be practiced using fibers from other heat-softenable mineral materials, such as rock, slag and basalt.

Figure 1:
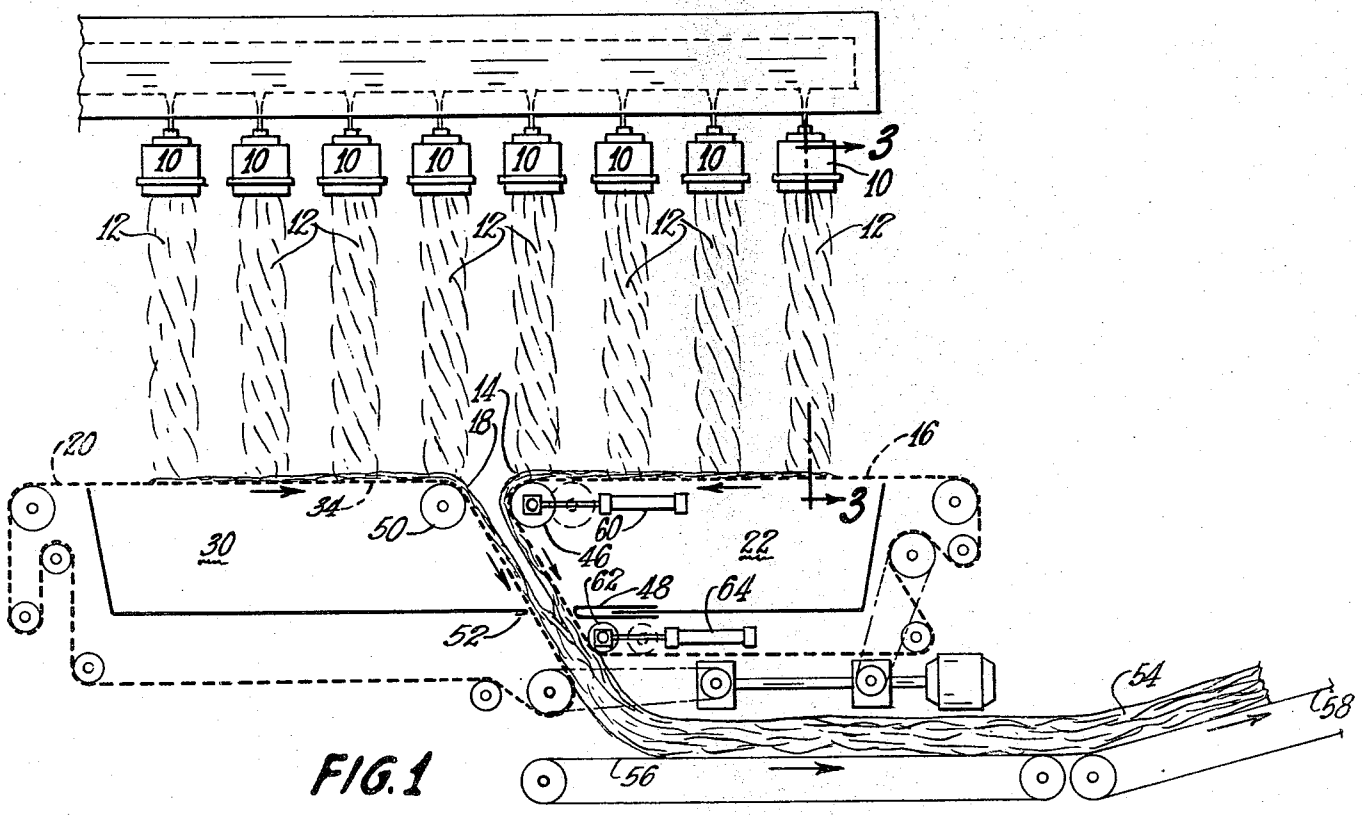
FIG. 1 is a cross-sectional view in elevation of apparatus for producing a laminated pack according to the principles of this invention.
Figure 2:
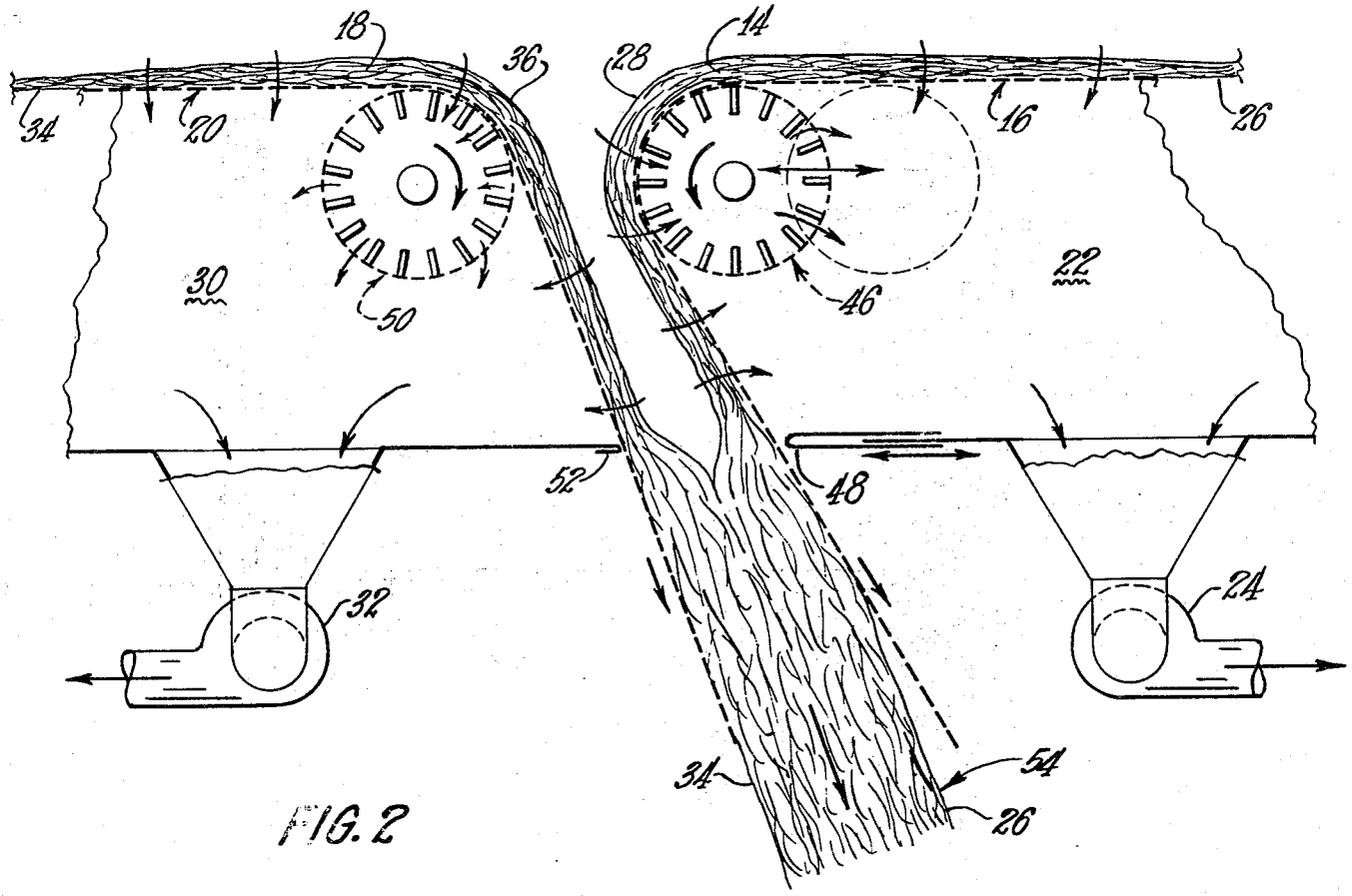
FIG. 2 is a cross-sectional view in elevation of a portion of the apparatus in FIG. 1.

As shown in FIGS. 1 and 2, a glass forehearth can be positioned to supply glass to sources of mineral fibers, such as fiberizers 10, which are positioned to successively deposit their streams or veils 12 of mineral fibers as first layer 14 of fibers on first forming conveyor 16, and second layer of fibers 18 on second forming conveyor 20, respectively. Positioned beneath the foraminous first conveyor is a first vacuum means, such as first exhaust plenum 22 and first exhaust fan 24, which provide sufficient suction to force substantially all of the mineral fibers downwardly onto the first forming conveyor, thereby crushing the bottom portion of the first layer and forming a first bottom surface 26 on the first layer which is smooth relative to the top surface 28 of the first layer. Likewise, a second vacuum means, such as second exhaust plenum 30 and second exhaust fan 32, are positioned beneath the second forming conveyor to provide suction to the mineral fibers sufficient to force substantially all of the mineral fibers downwardly onto the second forming conveyor, thereby crushing the bottom portion of the second layer and forming second bottom surface 34 on the second layer which is smooth relative to second top surface 36 of the second layer.

Figure 3:
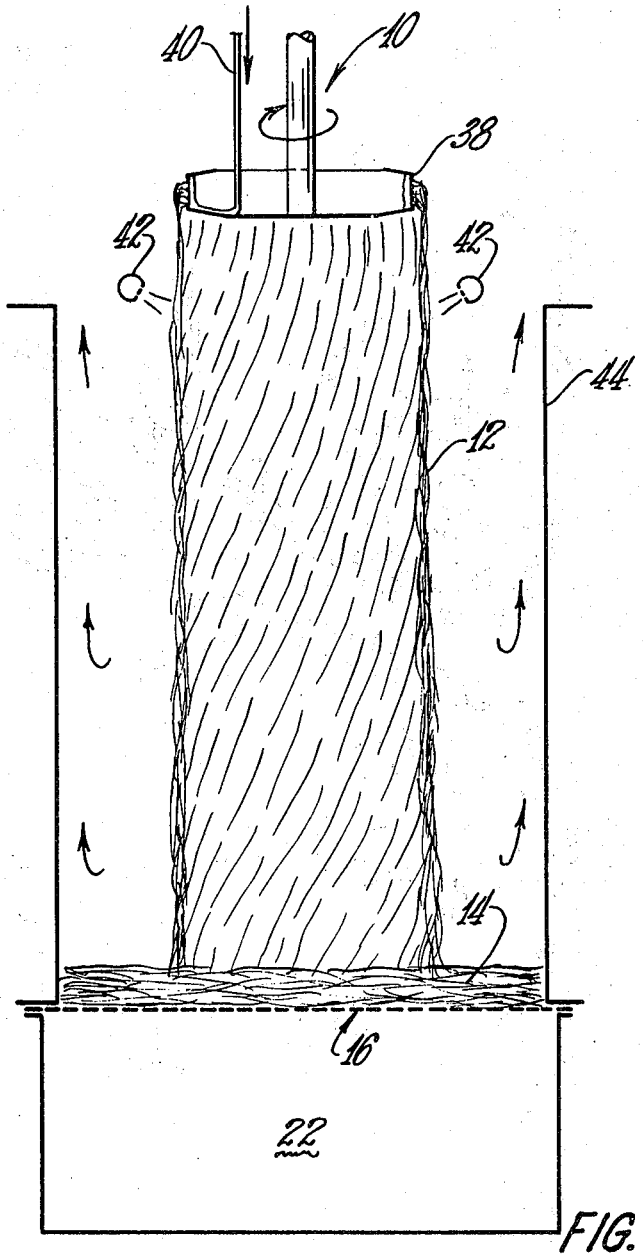
FIG. 3 is a cross-sectional view in elevation of the apparatus of FIG. 1 taken along line 3—3 under conditions in which blowback is occurring.

FIG. 3 shows conditions in which blowback is occurring because the suction is not great enough to pull substantially all of the fibers down onto the forming conveyor. As shown, the fiberizer can be comprised of rotatably mounted spinner 38 adapted to receive molten glass stream 40 and to centrifuge the molten glass into the veil of glass fibers, which can be distributed within forming hood 44 and across the width of the forming conveyor. The arrows within the forming hood indicate the direction of flow of some of the fibers in a blowback condition, i.e., when the suction is insufficient to pull substantially all of the fibers down onto the forming conveyor.

After the first layer is formed on the forming conveyor, the path of the first layer is changed to a generally downward direction by a means for changing the direction, such as by first slot roll 46 about which the first forming conveyor travels. The first slot roll can have slots extending therethrough to enable the flow of air therethrough and thereby maintain the suction on the first layer while the first layer of fibers is being turned to a downward direction. Any means suitable for turning the first layer downward while maintaining the suction of the first layer will be sufficient for practice of the invention. The first forming conveyor remains in contact with the first exhaust plenum until a position downstream from the slot roll, where first seal 48 provides a boundary between the partially evacuated first exhaust plenum and non-evacuated space.

Means for turning the second layer of fibers, such as second slot roll 50, can be employed to turn the second layer of fibers downwardly, and second seal 52 provides a boundary between the partially evacuated second exhaust plenum and unevacuated space. As the first layer of fibers passes the first seal, the suction is released, and the first layer of fibers springs up or expands into a thicker pack. Likewise, the second layer of fibers expands upon passing the second seal. Thus, the first and second forming conveyors define a passageway therebetween, and comprise the means for joining the top surfaces of the first and second layers to produce a laminated pack having as its outer surfaces the first and second bottom surfaces. The two layers of fibers are held together by the first and second forming conveyors as they travel generally vertically downward as laminated pack 54. The laminated pack can be transported by take-away conveyor 56 and ramp conveyor 58 to such downstream equipment as curing ovens, facing operations, and packaging, not shown.

As shown in FIG. 1, the first slot roll can be adapted with means for moving it in a direction toward or away from the second forming conveyor. Any suitable means such as hydraulic cylinder 60 can be utilized. Likewise, idler roll 62 about which the first forming conveyor travels can also be adapted with means, such as idler hydraulic cylinder 64, for movement in the direction toward or away from the second forming conveyor. The movement of first slot roll and the idler roll toward or away from the second forming conveyor enables adjustment of the spacing and angle between the two forming conveyors as the top surfaces of the first and second layers are joined to produce a laminated pack having as its outer surfaces the first and second bottom surfaces.

It will be evident from the foregoing that various modifications can be made to this invention. Such, however, are considered as being within the scope of the invention.

INDUSTRIAL APPLICABILITY

This invention will be found to be useful in the formation of fibers from molten glass for such uses as glass fiber thermal insulation products and glass fiber acoustical insulation products.

We claim:

1. Apparatus for producing a laminated pack of mineral fibers comprising (a) a first forming conveyor, a plurality of sources of mineral fibers positioned to successively deposit mineral fibers onto said first forming conveyor to form a first layer of mineral fibers, and first vacuum means to provide suction to said mineral fibers through said first forming conveyor, said first vacuum means being adapted to provide sufficient suction to force substantially all of the mineral fibers downwardly onto the first forming conveyor, thereby crushing the bottom portion of said first layer and forming a first bottom surface on said first layer which is smooth relative to the top surface of said first layer (b) a second forming conveyor, a plurality of sources of mineral fibers positioned to successively deposit mineral fibers onto said second forming conveyor to form a second layer of mineral fibers, second vacuum means to provide suction to said mineral fibers through said second forming conveyor, said second vacuum means being adapted to provide sufficient suction to force substantially all of the mineral fibers downwardly onto the second forming conveyor, thereby crushing the bottom portion of said second layer and forming a second bottom surface on said second layer which is smooth relative to the top surface of said second layer, and means for changing the path of said second layer to a generally downward direction while maintaining the suction on said second layer; and (c) means for joining said top surfaces of said first and second layers to produce a laminated pack having as its outer surfaces of said first and second bottom surfaces.

2. The apparatus of claim 1 in which said means for changing the path of said first layer comprises a rotatable slot roll around which said first forming conveyor travels.

3. The apparatus of claim 2 in which said means for joining comprises said first forming conveyor and said second forming conveyor.

4. The apparatus of claims 2 or 3 in which said means for changing the path of said second layer comprises a second rotatable slot roll around which said second forming conveyor travels.

5. The apparatus of claim 4 comprising means for moving the first rotatable slot roll in a direction toward or away from said second forming conveyor.

6. Apparatus for producing a laminated pack of mineral fibers comprising (a) a first forming conveyor, a plurality of sources of mineral fibers positioned to successively deposit mineral fibers onto said first forming conveyor to form a first layer of mineral fibers, first vacuum means to provide suction to said mineral fibers through said first forming conveyor, said first vacuum means being adapted to provide sufficient suction to force substantially all of the mineral fibers downwardly onto the first forming conveyor, thereby crushing the bottom portion of said first layer and forming a first bottom surface on said first layer which is smooth relative to the top surface of said first layer, and means for changing the path of said first layer to a generally downward direction while maintaining the suction on said first layer;

(b) a second forming conveyor, a plurality of sources of mineral fibers positioned to successively deposit mineral fibers onto said second forming conveyor to form a second layer of mineral fibers, second vacuum means to provide suction to said mineral fibers through said second forming conveyor, said second vacuum means being adapted to provide sufficient suction to force substantially all of the mineral fibers downwardly onto the second forming conveyor, thereby crushing the bottom portion of said second layer and forming a second bottom surface on said second layer which is smooth relative to the top surface of said second layer, and means for changing the path of said second layer to a generally downward direction while maintaining the suction on said second layer; and where (c) said first forming conveyor is positioned adjacent said second forming conveyor so that after the paths of said first and second layers are turned downward said top surfaces of said first and second layers are joined to produce a laminated pack having as its outer surfaces said first and second bottom surfaces.

7. The apparatus of claim 6 comprising means for moving one of said forming conveyors in a direction toward or away from the other of said forming conveyors.

8. The method for producing a laminated pack of mineral fibers comprising (a) Successively depositing mineral fibers from a plurality of sources of mineral fibers onto a first forming conveyor to form a first layer of mineral fibers, and providing suction to said mineral fibers through said first forming conveyor, the suction being sufficient to force substantially all of the mineral fibers downwardly onto the first forming conveyor, thereby crushing the bottom portion of said first layer and forming a first bottom surface on said first layer which is smooth relative to the top surface of said first layer;

(b) successively depositing mineral fibers from a plurality of sources of mineral fibers onto a second forming conveyor to form a second layer of mineral fibers, providing suction to said mineral fibers through said second forming conveyor, the suction being sufficient to force substantially all of the mineral fibers downwardly onto the second forming conveyor, thereby crushing the bottom portion of said second layer and forming a second bottom surface on said second layer which is smooth relative to the top surface of said second layer, and changing the path of said second layer to a generally downward direction while maintaining the suction on said second layer; and (c) joining said top surfaces of said first and second layers to produce a laminated pack having as its outer surfaces said first and second bottom surfaces.

9. The method of claim 8 comprising joining said top surfaces by directing said first and second layers between said first and second forming conveyors.

10. The method of claim 9 comprising changing the paths of said first and second layers by turning said first and second layers downwardly around first and second slot rolls, respectively.

11. The method of claim 8 comprising changing the path of said first layer to a generally downward direction while maintaining the suction on said first layer.

12. A mineral fiber insulation pack made by the method of claim 8.

13. A mineral fiber insulation pack made by the method of claim 11.

14. A mineral fiber insulation pack made by the method of claim 9.

15. The method for producing a laminated pack of mineral fibers comprising (a) Successively depositing mineral fibers from a plurality of sources of mineral fibers onto a first forming conveyor to form a first layer of mineral fibers, and providing suction to said mineral fibers through said first forming conveyor, the suction being sufficient to force substantially all of the mineral fibers downwardly onto the first forming conveyor, thereby crushing the bottom portion of said first layer and forming a first bottom surface on said first layer which is smooth relative to the top surface of said first layer;

(b) successively depositing mineral fibers from a plurality of sources of mineral fibers onto a second forming conveyor to form a second layer of mineral fibers, providing suction to said mineral fibers through said second forming conveyor, the suction being sufficient to force substantially all of the mineral fibers downwardly onto the second forming conveyor, thereby crushing the bottom portion of said second layer and forming a second bottom surface on said second layer which is smooth relative to the top surface of said second layer; and (c) Changing the path of one or both of said layers to join said top surfaces of said layers to produce a laminated pack having as its outer surfaces said first and second bottom surfaces, where the suction on said layer or layers is maintained as its path is being changed.

16. Apparatus for producing a laminated pack of mineral fibers comprising (a) a first forming conveyor, a plurality of sources of mineral fibers positioned to successively deposit mineral fibers onto said first forming conveyor to form a first layer of mineral fibers, and first vacuum means to provide suction to said mineral fibers through said first forming conveyor, said first vacuum means being adapted to provide sufficient suction to force substantially all of the mineral fibers downwardly onto the first forming conveyor, thereby crushing the bottom portion of said first layer and forming a first bottom surface on said first layer which is smooth relative to the top surface of said first layer;

(b) a second forming conveyor, a plurality of sources of mineral fibers positioned to successively deposit mineral fibers onto said second forming conveyor to form a second layer of mineral fibers, second vacuum means to provide suction to said mineral fibers through said second forming conveyor, said second vacuum means being adapted to provide sufficient suction to force substantially all of the mineral fibers downwardly onto a second forming conveyor, thereby crushing the bottom portion of said second layer and forming a second bottom surface on said second layer which is smooth relative to the top surface of said second layer;

(c) means for changing the path of either said first layer or said second layer or both to join said top surfaces of said first and second layers to produce a laminated pack having as its outer surfaces said first and second bottom surfaces; and (d) means for maintaining the suction on said layer or layers as its path is being changed.

* * * * *